United States Patent [19]

Steinberg

[11] 4,102,403

[45] Jul. 25, 1978

[54] APPARATUS FOR MAKING A SLIT TRENCH

[75] Inventor: Richard W. Steinberg, Mankato, Minn.

[73] Assignee: Vibra-King, Inc., Mankato, Minn.

[21] Appl. No.: 732,796

[22] Filed: Oct. 15, 1976

[51] Int. Cl.[2] ..... E02F 5/18

[52] U.S. Cl. ..... 172/40; 172/413; 172/477; 172/699; 37/DIG. 18

[58] Field of Search ..... 172/40, 699, 413, 477; 37/DIG. 18, 193, 98; 61/72.6; 299/14; 173/49

[56] References Cited

U.S. PATENT DOCUMENTS

| | | | |
|---|---|---|---|
| 3,232,358 | 2/1966 | Heiberg | 61/72.6 X |
| 3,336,082 | 8/1967 | Bodine, Jr. | 172/40 X |
| 3,613,803 | 10/1971 | Payne | 37/193 X |
| 3,657,831 | 4/1972 | Kant | 37/193 |
| 3,685,591 | 8/1972 | Ulrich et al. | 172/40 |
| 3,746,100 | 7/1973 | Hall et al. | 172/40 |
| 3,757,869 | 9/1973 | Gagne | 172/40 |
| 3,935,712 | 2/1976 | Erickson et al. | 172/40 X |
| 3,952,810 | 4/1976 | Ulrich | 172/40 |

*Primary Examiner*—Clifford D. Crowder

*Attorney, Agent, or Firm*—Burd, Braddock & Bartz

[57] ABSTRACT

A crawler tractor is connected to a cable, pipe and line laying machine with a hitch assembly. The hitch assembly has a transverse drawbar secured to forwardly directed side members. The side members being pivotally mounted to the side frames of the tractor are raised and lowered with a pair of double acting hydraulic cylinders. The machine has a frame attached to the drawbar. An annular resilient and flexible member pivotally mounts a body on the frame. An attitude control cylinder connected to the frame and body adjusts the angular position of the body and a plow standard connected to the body. Plow standard is connected to the body with link and connecting members. On forward movement of the tractor, the plow standard is moved through the soil to form a slit trench for the cable, pipe or line. The connecting members are mounted on a crank shaft rotated by a hydraulic motor to provide the standard with an orbital movement. A wheel assembly having legs pivotally mounted to the body is controlled with a pair of double acting hydraulic cylinders to regulate the ground working depth of the standard.

41 Claims, 8 Drawing Figures

46
66
71
47
67
64
65
62
63
68
61
69
59
103
97
109
99
107
82
72
73
77
76
118
78
117
111
113
91
89
86
104
66
54
52
59
47
53
26
116
121
119
56
57
22
27
58

FIG. 5
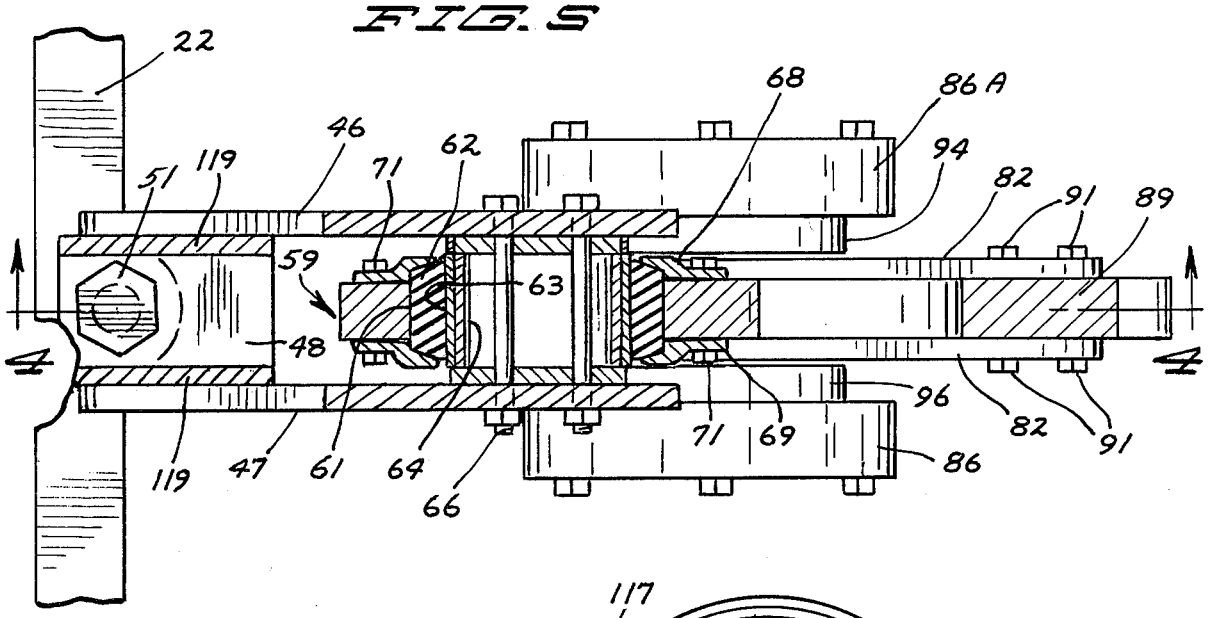
FIG. 4
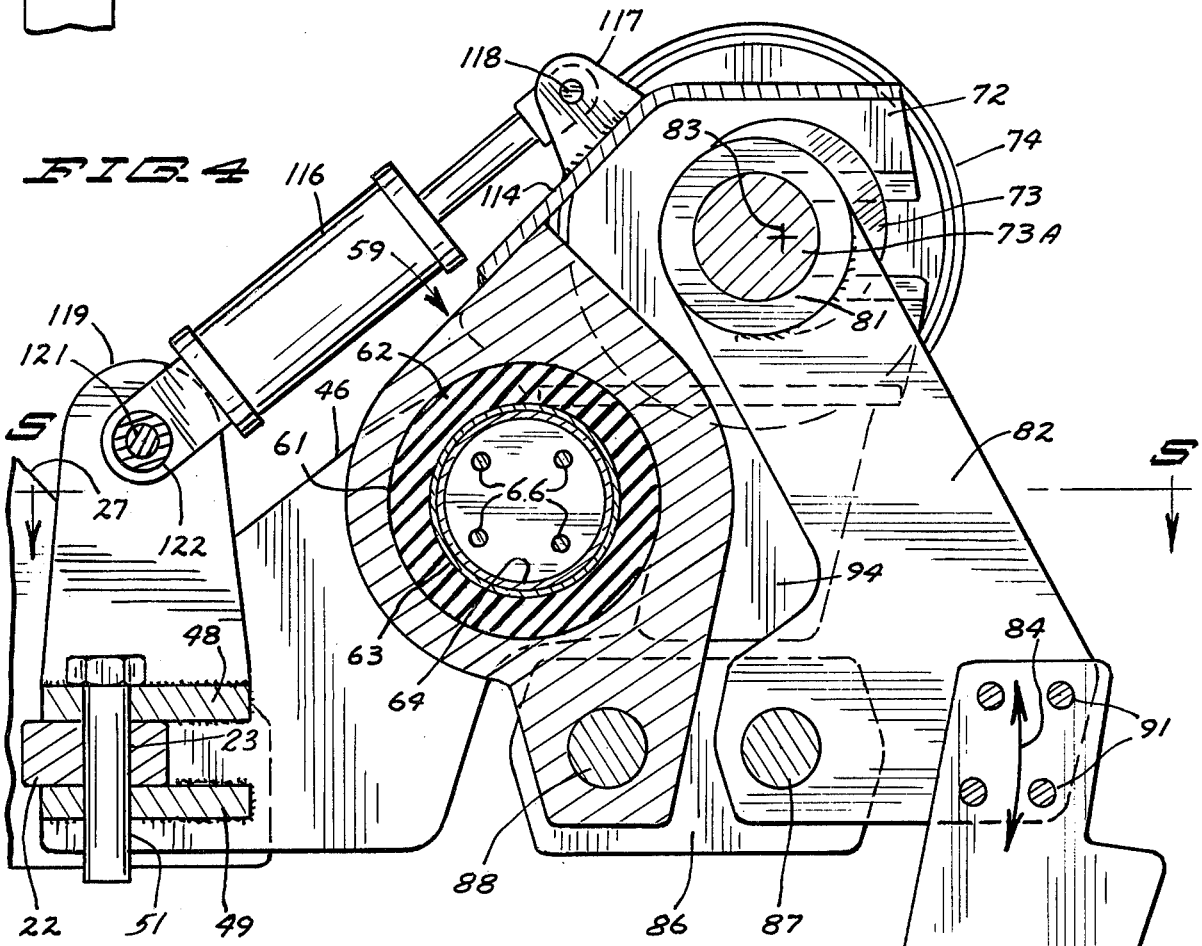
FIG. 7
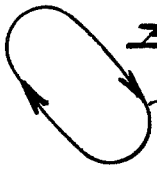
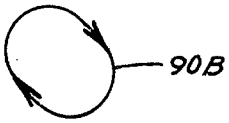
FIG. 6

APPARATUS FOR MAKING A SLIT TRENCH

BACKGROUND OF THE INVENTION

Cable and pipe laying machines pulled by tractors have been developed to continuously lay cable or pipe below the surface of the ground. These machines have an elongated ground engaging trenching member mounted on a frame structure. The mounting includes eccentric structures that provide the ground engaging trenching member with oscillatory or orbital motion. Orbital motion to the trenching member as it advances into the ground is advantageous as it reduces the drag on the member. The orbital motion imparted to the trenching member is transmitted to the entire machine, including the draft vehicle. Elastomeric mountings have been used to isolate vibrating parts, as the trenching member, from the frame. Examples of cable laying machines having elastic mountings are shown by Rogroden in U.S. Pat. No. 3,575,006, Davis in U.S. Pat. No. 3,618,237, and Hall et al in U.S. Pat. No. 3,746,100. Additional cable laying machines are shown by Hinkel et al in U.S. Pat. No. 3,140,745, Gagne in U.S. Pat. No. 3,326,010, Kinnan et al in U.S. Pat. No. 3,608,322, Olson in U.S. Pat. No. 3,702,062, Scerbo et al in U.S. Pat. No. 3,863,721, Ericson et al in U.S. Pat. No. 3,935,712 and Ulrich in U.S. Pat. No. 3,952,810.

SUMMARY OF THE INVENTION

The invention is directed to an apparatus for forming a continuous slit trench in the ground to facilitate the laying of lines, cables, pipes, and the like, under the ground and a hitch assembly for coupling the apparatus to a track type tractor. The apparatus has a frame equipped with a hitch releasably connected to the hitch assembly. A body is connected to the frame through an annular resilient and elastic member. The elastic member is located within a hole or bore in the body and is under axial and radial compression. An attitude control cylinder connected to the body and frame functions to control the angular position of the body. A member located behind the body is secured to a downwardly directed ground penetrating standard or plow. Link means pivotally connect lower portions of the body and member together. A crank shaft having an eccentric section is connected to the member and operates to provide the plow with orbital motion to facilitate the movement of the plow through the ground. The annular resilient and elastic member functions as an energy receiving and transmitting means. The orbital motion caused by the rotating crank shaft is transmitted via the member to the annular resilient and elastic member causing diametric opposite sections of the elastic member to sequentially expand and contract and thereby transmit reactive orbital motion to the plow. The elastic member operates to store energy and alter the orbital movement of the lower end of the plow. The plow under heavy load has a high impact force with a smaller path of orbital movement. The rear portion of the apparatus is supported on the ground with a wheel assembly. The depth of the plow is controlled by hydraulic cylinders connected to the wheel assembly which function to reposition the wheel assembly relative to the plow, thereby controlling the depth of the plow.

The hitch assembly has forwardly directed side members located adjacent the side frame of the crawler tractor. Pivot means pivotally connect the side members to the adjacent side frames so that the drawbar connected to the rear portions of the side members can be selectively raised and lowered. A pair of expandable and contractable means, as double acting hydraulic cylinders, are connected to the side members and upright fixed members secured to the midsections of the side frames. The expandable and contractable means function to selectively raise and lower the drawbar.

An object of the invention is to provide an apparatus for laying linear structures under the ground with an annular energy storing and transmitting member that works in conjunction with means providing orbital motion to a plow extended into the ground. Another object of the invention is to provide plow apparatus having an elongated plow with an elastic energy storing and dissipating member that decreases the orbital movement of the plow as the load on the plow increases. Yet another object of the invention is to provide a plow apparatus with a plow standard that can be moved to a selected upright position. A further object of the invention is to provide a crawler tractor with a hitch assembly connected to an apparatus from a normal ground working position to an elevated transport position. A further object of the invention is to provide a hitch assembly for connecting a draft vehicle to an apparatus for forming a continuous slit trench in the ground that permits the vehicle and apparatus to turn on a relatively short turning radius without exerting excessive side pressure on the ground penetrating plow. An additional object of the invention is to provide a hitch assembly for connecting a vibrating ground engaging implement to a draft vehicle in a manner that minimizes the transfer of vibration and shock forces to the motor and transmission of the vehicle and the operator of the vehicle.

IN THE DRAWINGS

FIG. 1 is a side elevational view of a crawler tractor connected to an apparatus for making a slit trench with a hitch assembly;

FIG. 4 is an enlarged sectional view taken along the line 4—4 of FIG. 2;

FIG. 6 is an enlarged sectional view of the annular resilient member connected to the side frames and the body of the apparatus;

FIG. 8 is a diagrammatic view of the orbital path of the tip of the lower nose of the plow under a heavy load.

DESCRIPTION OF PREFERRED EMBODIMENT

Figure 2:
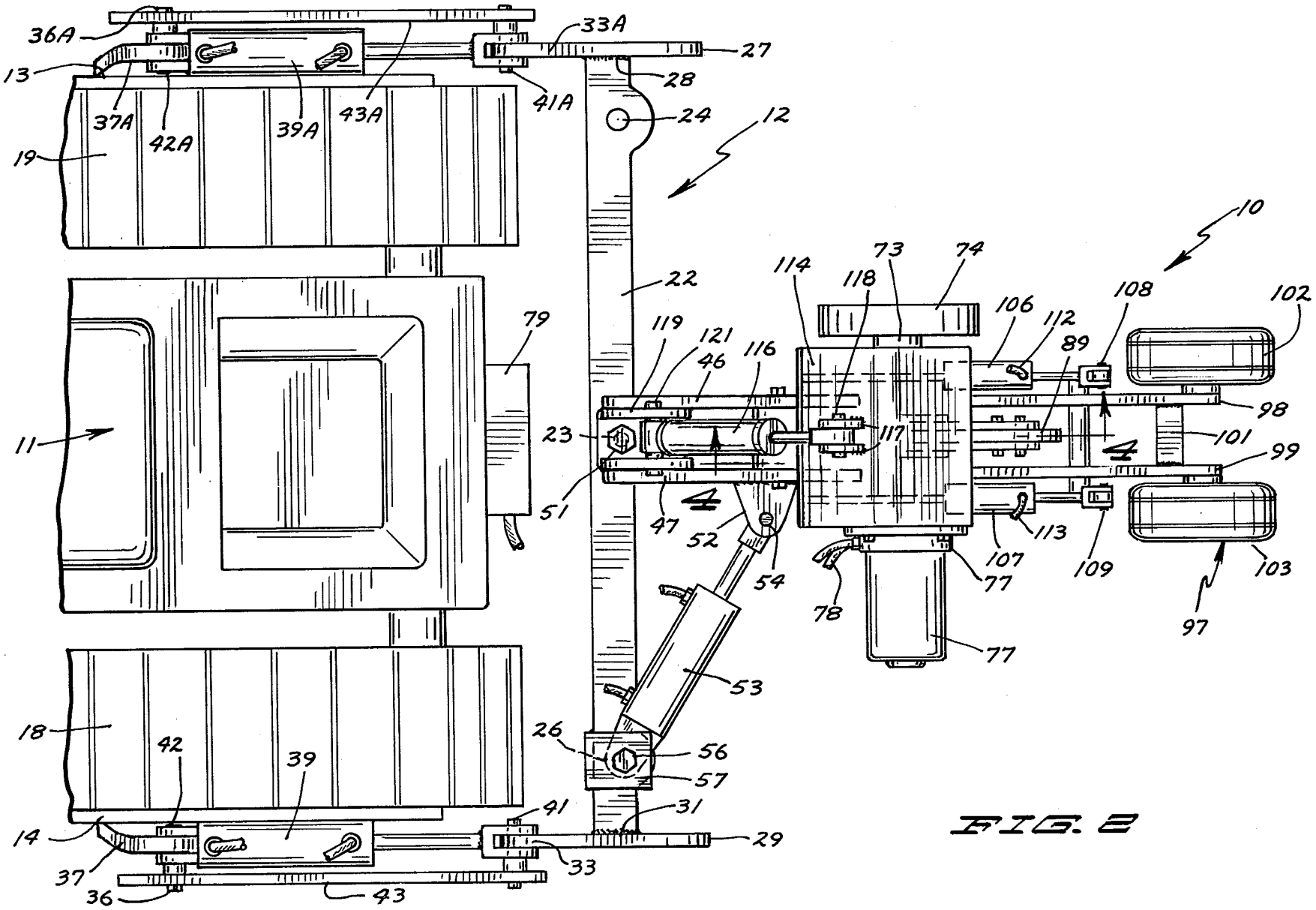
FIG. 2 is an enlarged plan view of the hitch assembly and apparatus of FIG. 1.

Referring to FIGS. 1 and 2, there is shown, indicated generally at 10, an implement for making a slit trench in the ground to facilitate the laying of cable, lines, pipe and the like structures under the ground. Implement 10 is commonly known as an underground cable and pipe laying machine. Implement 10 is connected to a crawler tractor 11 with a hitch assembly indicated generally at 12. Tractor 11 is a conventional crawler or tractor having longitudinal horizontal side frames 13 and 14. Front or idler sprockets 16 are rotatably mounted on the front end of the side frames 13 and 14. Drive sprockets 17 are rotatably mounted on the rear portions of the side frame 13 and 14. The drive sprockets 17 are connected in the conventional manner to the drive transmission structure of tractor 11. Tractor 11 has endless tracks 18 and 19 trained about the sprockets 16 and 17. Tracks 18 and 19 movably support the tractor 11 on the ground 21.

Hitch assembly 12 has a transverse member or drawbar 22. Bar 22 is of a generally rectangular shape and is formed from strong metal, such as steel. Bar 22 has a center hole 23 and side holes 24 and 26 for accommodating draft pins used to connect an object, as a trailer or implement and control structures to drawbar 22. Pin 51 connects implement 10 to drawbar 22. As shown in FIG. 2, a first forwardly directed side member 27 is secured by welds 28 to one end of bar 22. A second side member 29 is secured by welds 31 to the opposite end of bar 22. Side members 27 and 29 are upright flat plates that extend in a forward direction adjacent the outside surfaces of side frames 13 and 14. Drawbar 22 is secured to the lower rear portions of side members 27 and 29.

Referring to FIG. 1, side member 29 has a forwardly directed portion or first arm 32 and an upwardly directed rear portion or second arm 33. A forwardly projected horizontal plate 34 secured to arm 32 carries a transverse pivot pin 36. Pivot pin 36 pivotally mounts the side member 29 on a fixed member 37 attached to side frame 14 for movement about a generally horizontal transverse axis. Side member 27 is identical in construction to the side member 29 and is pivotally connected to a fixed member 37A attached to side frame 13 with a transverse pivot pin 36A that is in axial alignment with the pivot member 36.

Upright support or fixed first member 37 is attached by a plurality of fasteners such as bolts 38 to the middle section of side member 14. An expandable and contractable structure shown as a double acting hydraulic cylinder 39 pivots the side member 29 on pivot pin 36 to raise or lower drawbar 22. Hydraulic 7 cylinder 39 has a piston rod connected with a pivot pin 41 to the arm 33. The opposite end of the cylinder 39 is connected with a pivot pin 42 to the top portion of fixed member 37. A rigid link or stabilizer bar 43 is pivotally connected to the pin 41 and slidably mounted on the pin 42. Bar 43 has an elongated longitudinal slot 44 accommodating pivot pin 42.

The opposite side of hitch assembly 12 has a similar upright fixed member 37A attached to middle section of side member 13 and a hydraulic cylinder 39A pivotally connected to the upright arm 33A of the side member 27 and the upper portion of the fixed member 37A. A stabilizer bar 43A is pivotally connected to pin 41A and slidably connected to pin 42A. The parts on the right side of the hitch assembly 12 that correspond to the parts on the left side of the hitch assembly 12 have identical reference numbers with the suffix A.

In use, the hydraulic cylinders 39 and 39A are connected to the hydraulic pressure system of the tractor and suitable control valves. Upon application of hydraulic pressure to the cylinders 39 and 39A, the side members 27 and 28 are pivoted about the generally transverse axes of pivot pins 36 and 36A to selectively raise and lower drawbar 22. The fixed members 37 and 37A being connected to the side frames 13 and 14 forwardly of the drive sprockets 17 transmit generally linear forces to the side frames. This maintains the balance or horizontal working position of the tractor and facilitates the steering of the tractor. Hitch assembly 12 being connected to the side frames 13 and 14 minimizes the vibration and shock forces subjected to drawbar 22 by apparatus 10 and the transmission of these forces to the tractor engine and transmission and the operator. The vibrations are transmitted to the side frames 13 and 14 and to the sprockets and tracks 18 and 19 mounted on the side frames. The hitch assembly 12 reduces operator fatigue and the detrimental effects of vibration and shock forces on the operating parts of tractor 11.

Figures 3, 5:
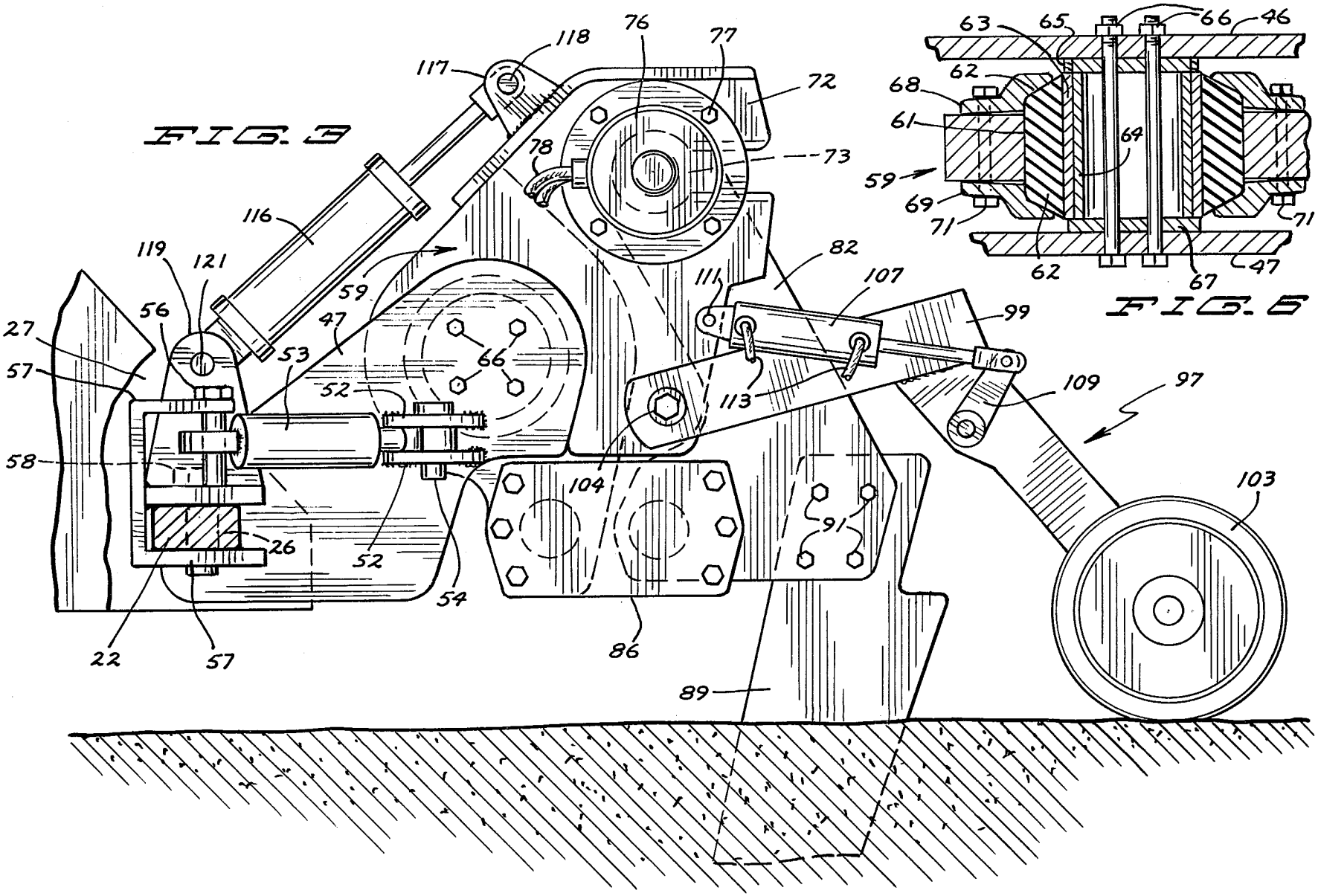
FIG. 3 is a side elevational view of the apparatus of FIG. 1 showing the plow foreshortened.
FIG. 5 is a sectional view taken along the line 5—5 of FIG. 4.

As shown in FIG. 2, implement 10 has a pair of rearwardly directed frames or plates 46 and 47. The frames 46 and 47 are flat plate-like members that are located in laterally spaced side-by-side vertical planes. A pair of transverse cross members or blocks 48 and 49 are located between and secured by welds to the forward ends of frames 46 and 47. Blocks 48 and 49 have aligned vertical holes for accommodating a draft pin 51. As shown in FIG. 5, pin 51 projects through the hole 23 in drawbar 22, thereby connecting implement 10 to drawbar 22.

Referring to FIGS. 2 and 3; frame 47 has a pair of laterally directed ears or side members 52 connected to a hydraulic cylinder 53 with an upright pin 54. A second pin 56 connects the opposite end of hydraulic cylinder 53 to a bracket 57. A pin 58 connects bracket 57 to the end of the drawbar 22 adjacent side member 29. Pin 58 projects through hole 26 in the end of drawbar 22. Hydraulic cylinder 53 is an expandable and contractable means operable to move implement 10 about the upright axis of pin 51. Cylinder 55 facilitates the turning of the tractor 11 and implement 10 when the standard or plow of the implement is in the ground. The turn radius of tractor 11 and implement 10 is reduced with the pulling action of cylinder 53. When implement 10 is raised to the transport position, cylinder 53 functions as a stabilizing strut holding the implement in a rearwardly directed position. Cylinder 53 can be removed by removing the pins 54 and 56. A solid bar or strut replaces the cylinder 53 to hold the apparatus 10 in a fixed rearward position relative to drawbar 22. The fixed link is used when apparatus 10 is raised to its extreme up or transport position.

A second frame or body indicated generally at 59 is interposed between the rear portions of frames 46 and 47. As shown in FIGS. 5 and 6, body 59 has a cylindrical opening or bore 61. An annular resilient and elastic member 62 mounted on an annular rim 63 is located within bore 61. Rim 63 fits around and engages a cylindrical sleeve or hub 64. The inside of rim 63 has a smooth cylindrical surface located in surface engagement with the outside cylindrical surface of hub 64 whereby the body 59 rotates about the transverse axis of hub 64. The opposite ends of hub 64 are in engagement with the inside walls of frames 46 and 47. An annular ring or sleeve 65 surrounds hub 64 and spaces the rim 63 from the side frame 46. A plate 67 engages the opposite end of rim 63 to space the rim 63 from the side frame 47. Ring 65 and plate 67 function as spacers to maintain the rim 63 and body 59 along the midline between the side frames 46 and 47. A plurality of nut-and-bolt assemblies 66 secure the hub 64 to frames 46 and 47. The annular resilient and elastic member 62 is under simultaneous transverse or axial compression and radial compression. Resilient member 62 engages a first side ring 68 bolted to one side of the frame 59 with bolts 71. The opposite side of resilient member 62 engages an annular side ring 69 secured to the frame 59 with bolts 71. Rings 68 and 69 contact opposite annular sides of elastic member 62. Bolts 71 function as clamps that hold the member 62 in axial compression. When member 62 is compressed axially, it expands radially into tight engagement with surface forming bore 61.

Resilient member 62 is made of solid hard rubber material, as neophrine rubber. Other types of elastic materials can be used for member 62. An example of a resilient member 62 is a solid continuous annular rubber member having an outside diameter of fifteen inches and a width of nine inches. The rubber member is bonded to a circular metal base band or rim 63. The annular member 62 has a generally rectangular cross sectional shape. The sides of member 62 taper inwardly in a radial outward direction. The member 62 has an axial width greater than the thickness of body 59.

As shown in FIGS. 3 and 4, frame 59 has upper portions 72 rotatably carrying a transverse crank shaft 73. A fly wheel 74 is secured to the one end of shaft 73. A cover 114 secured to the top of body 59 encloses the top of the crank shaft 73 and the bearings (not shown) supporting the crank shaft on body 59. Shaft 73 is driven with a hydraulic motor 76 mounted on body 59 with a plurality of bolts 77. Lines 78 carrying hydraulic fluid under pressure and connect the hydraulic motor 76 with a pump 79 mounted on the back of the tractor 11. As shown in FIG. 2, pump 79 is connected to a power take-off shaft of tractor 11 and operates independently of the hydraulic system of the tractor to supply hydraulic fluid under pressure to fluid motor 76. Pump 79 can be a combined reservoir and pump. The pumping unit is mounted on the inside of the reservoir so that the fluid, as oil, in the reservoir functions as a heat sink and cools the pump. Other types of pumps can be used to supply hydraulic fluid under pressure to motor 76. Suitable fluid control valves (not shown) are interposed in the line 78 connecting the pump 79 with the fluid motor 76 to control the operation as well as the speed of fluid motor 76.

Figure 7:
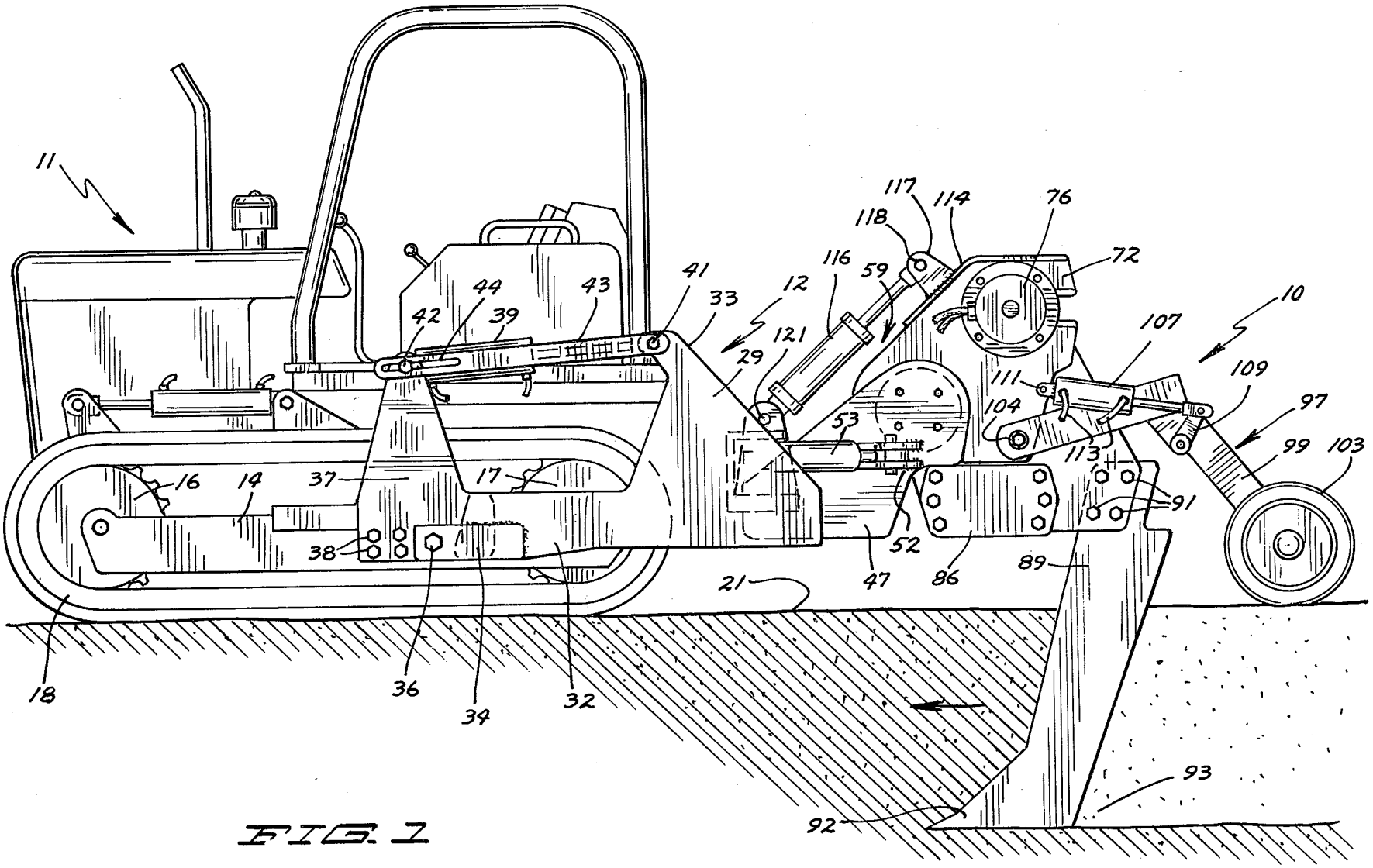
FIG. 7 is a diagrammatic representation of the path of orbital movement of the lower nose of the plow under a light load.

Returning to FIG. 4, crank shaft 73 has a crank or offset eccentric cylindrical portion 73A accommodating a sleeve or cylindrical bearing member 81. A pair of downwardly directed arms 82 are attached to the sleeve 81. The crank portion 73A moves in an eccentric or orbital path around the axis 83 thereby moving the arms 82 in generally up-and-down directions as indicated by the arrows 84. The lower forward ends of arms 82 are attached to two side links 86 and 86A with pivot members 87. The forward ends of links 86 and 86A are attached to bottom portions of the body 59 with a transverse pivot 88. A downwardly directed standard or plow 89 is secured to lower portions of the arms 82 with a plurality of bolts 91. The standard 89 has a lower forwardly directed nose 92 having a pointed forward end. The pointed end of nose 92 is in general vertical alignment with the axis of hub 64. The nose 92, upon rotation of the crank shaft, has an orbital motion in the general upright plane of standard 89. The orbital path of the motion of the nose 92 is along an upward and forward line. FIG. 7 is a diagrammatic view of the orbital path 90A of the nose 92 when the plow 89 is under light or no load. The major axis of the orbit follows an upward and forward line. FIG. 8 illustrates the orbital path 90B of nose 92 when the plow 89 is under heavy load such as when the plow encounters a rock or similar hard object. The orbital path of 90B approaches a circle as it has a smaller length than the path 90A. The energy of the plow 89 caused by the rotating crank shaft 73 is transmitted to the annular resilient member 62 when the plow 89 is under heavy load. The resilient member 62 causes the plow 89 to have a high impact force at a diminished stroke or reduced orbital movement. The greater the load on the plow 89, the smaller the orbital path of the nose 92. The orbital movement of nose 92 is variable in accordance with the load on plow 89 from a generally elongated upwardly extended orbital path 90A shown in FIG. 7 to the generally circular orbital path 90B shown in FIG. 8. The contoured shape of the nose functions to lift the soil as it orbits through the ground to form the slit or trench 93 for accommodating linear structures, as pipe, cable, electric lines and the like. The orbital movement of plow 89 facilitates the linear movement of the plow 89 through the soil. In other words, the drawbar pull of implement 10 is reduced by the orbital movement of plow 89.

Referring to FIGS. 4 and 5, body 59 has a pair of generally longitudinal upright plates 94 and 96 disposed on opposite sides of the arms 82. Plates 94 and 96 are laterally spaced from each other to provide a guideway for orbital movement of the arms 82 in a generally vertical plane. The plates 94 and 96 provide the arms 82 and standard 89 with lateral reinforcement as a substantial length of the side of the arms 82 can engage the plates 94 and 96.

As shown in FIGS. 1, 2 and 3, a rearwardly directed wheel assembly indicated generally at 97 operates to control the depth of standard 89. Wheel assembly 97 has a pair of angularly disposed legs 98 and 99. A cross member 101, as shown in FIG. 2, is connected to the lower ends of legs 98 and 99. A first wheel 102 having a pneumatic tire is rotatably mounted on the lower end of leg 98. A second wheel 103 having a pneumatic tire is rotatably mounted on the lower end of leg 99. Referring to FIGS. 1 and 3, a pivot member 104 pivotally connects the forward end of leg 99 to the frame 59. A similar pivot member (not shown) pivotally connects the leg 98 to the frame 59. The pivotal movement of the legs 98 and 99 is controlled with a pair of hydraulic double acting cylinders 106 and 107. Hydraulic cylinder 106 is pivotally connected to an upright member 108 secured to the midportion of leg 99 and is pivotally connected to the rod end of hydraulic cylinder 107. A pin 111, as shown in FIGS. 1 and 3, pivotally connects the cylinder end of hydraulic cylinder 107 to the body 59 above the pivot member 104. A similar pivot pin (not shown) connects the cylinder end of hydraulic cylinder 106 to the body 59. The hydraulic cylinders 106 and 107 are connected with lines 112 and 113 to a source of hydraulic pressure, such as pump 79. Suitable valve structure (not shown) is interposed in the lines 112 and 113 to control the expansion and contraction of the cylinders 106 and 107 and thereby vary the depth of the nose 92 on the lower end of standard 89 in the ground 21.

Wheels 102 and 103 also function to close the slit formed by the plow 89. When the drawbar 22 is placed in the float position by releasing the hydraulic pressure from the cylinders 39 and 39A, the depth of the plow 89 is controlled by the rear wheel assembly 97. The hitch assembly 12 can be used for depth control of plow 89. In soft ground conditions, the wheels 102 and 103 will sink into the ground when the cylinders 39 and 39A are in float positions. These cylinders 39 and 39A can be used to facilitate the depth control of plow 89 by fixing the elevation of the drawbar 22.

The upright position of plow 89 is controlled with an attitude control cylinder 116. Cylinder 116 is a double acting hydraulic cylinder having a rod end pivotally connected to a pair of ears or members 117 secured to the body 59 or cover 114 with a pivot pin 118. The opposite end of the cylinder 116 is pivotally connected to a pair of upright members 119 with a transverse pin 121. The upright members 119 are secured to cross member 48. The pin 121 fits through a resilient sleeve or tube 122 to isolate the shock forces transmitted through the cylinder 116 to the frame members 46 and 47.

The forward portion of nose 92 is located in general vertical alignment with the transverse axis of the annular elastic and resilient member 62. The location of the nose 92 relative to a vertical line passing through the transverse axis of member 62 can be controlled by the use of attitude cylinder 116. When the cylinder 116 is shortened, the body 59 pivots about the axis of drum 64 moving the standard 89 in a rearward direction. This moves point 92 away from the upright line passing through the axis of drum 64. When cylinder 116 is extended or expanded, the body 59 pivots in a clockwise direction moving the standard 89 in a forward direction. The attitude cylinder 116 is thus used to change the pitch or angular inclination of standard 89 to insure that the point or nose 92 is in general vertical alignment with a line passing through the transverse axis of drum 64. The attitude cylinder 116 allows the standard 89 to follow the contour of the ground and yet maintain the nose 92 in general vertical alignment with the transverse axis of drum 64.

In use, tractor 11 operates to pull the apparatus 10 along the ground to form a slit trench in the ground. Linear structure, as the cable, line or pipe, carried by tractor 11 or a separate vehicle continuously moves down the back of standard 89 to the bottom of the trench. Tractor 11 drives the pump 79 to supply hydraulic fluid under pressure to the hydraulic fluid motor 77. Motor 77 drives the crank shaft 73 and thereby rotates the fly wheel 74. The nose 92 of standard 89 moves in a forward and upward orbital direction. The rotating crank shaft repetitively moves the standard 89 in an orbital path as indicated by the arrows 90A in FIG. 7 when under light load. When standard 89 is under heavy load, the orbital movement of nose 92 is diminished and changes from a generally elongated orbital movement to a shortened generally circular orbital movement as shown by the arrows 90B in FIG. 8. The annular resilient and elastic member 62 functions as an elastic annular spring that provides for the variable orbit of nose 92. The energy transmitted through the standard or plow 89 by the eccentric crank 73A is transmitted to the annular resilient and elastic member 62 when the load increases on the standard 89. The result is that the standard has a high impact force at a diminished stroke or reduced orbit movement. In use, there is a higher potential of breaking the hard rock and hard areas in the ground as the plow has an orbital movement that breaks down the adhesive or holding forces of the soil. This variable orbital movement of the plow 89 has the beneficial effect of moving the standard 89 through the soil with less horsepower than a static earthworking tool.

The annular and resilient member 62 is an annular biasing structure that insulates the shocks and vibrations of the body 59 from the frame structures 46 and 47 of apparatus 10. The annular resilient and elastic member also functions as an energy receiving and transmitting unit. The orbital motion caused by the rotating crank shaft 73 is transmitted through the body 59 to the annular elastic member 62. This causes portions of diametrically opposite sections of the elastic member 62 to sequentially expand and contract. Applicant has found that the one o'clock and seven o'clock sectors of the member 62 have the maximum oscillatory movement. This movement varies with the load on the standard 89. When the load increases, the movement increases. The spring or reaction movement of the elastic member 62 is transmitted back to body 59 and provides a reactive orbital motion to the standard 89. The reactive orbital motion is in phase relationship with the orbital motion caused by the rotating crank shaft 73 whereby the standard orbital a maximum orbita movement and power with a minimum of energy or work input via the hydraulic motor 77.

The turning of the tractor 11 is achieved by braking one of the tracks 19. The turning is facilitated with the use of the hydraulic cylinder 53. Hydraulic cylinder 53 can operate to push and pull the implement and thereby pivot the implement about the pin 51 in the direction of the turning of the tractor 11.

The depth of the standard 89 is controlled by the position of the wheel assembly 97 relative to the frame of apparatus 10. Hydraulic cylinders 106 and 107 are operable to pivot the wheel assembly 87 thereby either raising or lowering the standard 89. The entire apparatus 10 can be moved to a transport or raised position wherein the entire standard 89 is elevated from the top of the ground. This is achieved with the hitch assembly 12. The hydraulic cylinders 39 and 39A function to pivot the drawbar 22 in an upward direction. Apparatus 10 being connected to the drawbar 22 with pin 21 and the double acting cylinder 53 is raised along with the drawbar 22 with the action of the hydraulic cylinders 39 and 39A.

The above description is directed to one embodiment of the apparatus for making a slit trench and hitch assembly connecting the apparatus to a crawler type tractor. Changes in the structures, structural relationships, materials and parts can be made by those skilled in the art without departing from the invention. The invention is defined in the following claims.

The embodiments of the invention in which an exclusive property or privilege is claimed are defined as follows:

1. Apparatus for making a continuous slit trench in the ground to facilitate the laying of linear structures, as lines, pipes, cables and the like, in the ground comprising: a frame having a forward portion adapted to be connected to a pulling vehicle, a body located adjacent said frame, said body having a cylindrical wall forming an opening through the body, means connecting the body to the frame, said means including a cylindrical hub extended through the opening, means mounting the hub on the frame, and an annular resilient and elastic member surrounding the hub and engageable with the cylindrical wall of the body; annular members mounted on the body and engageable with the sides of said annular resilient and elastic member to hold the annular resilient and elastic member under compression; a member located adjacent the body, link means pivotally connecting lower portions of the body and member; a ground penetrating plow secured to the member adapted to make a slit trench on forward movement of the apparatus; and means connected to the member operable to move the plow in an orbital path along the length of the plow, said annular resilient and elastic member being an energy receiving and transmitting member operable to alter the orbital movement of the plow in relation to the load applied to the plow.

2. The apparatus of claim 1 including: a wheel assembly mounted on the frame and engageable with the ground to control the depth of the plow in the ground.

3. The apparatus of claim 1 wherein: the frame has a pair of flat plate members located in spaced side-by-side vertical planes, said forward portion having a pair of cross members extend between and secured to the plate members, said cross members having aligned vertical holes to accommodate a pin for connecting the frame to a pulling vehicle.

4. The apparatus of claim 1 including: adjustable means engageable with the annular members for adjusting the compression of the annular resilient and elastic member.

5. The apparatus of claim 1 wherein: the plow has a forwardly directed lower nose located in general vertical alignment with the transverse axis of the annular resilient and elastic member.

6. The apparatus of claim 1 wherein: the means connected to the member operable to move the plow in an orbital path includes a crank shaft having an off-set portion connected to the member, and means to rotate the crank shaft.

7. The apparatus of claim 1 including: a wheel assembly for controlling the depth of the plow in the ground, said wheel assembly having a pair of legs pivotally connected to the frame, ground engaging wheels rotatably mounted on the legs, and power means for rotating the legs to selectively raise or lower the standard relative to the ground.

8. The apparatus of claim 1 including: adjustable means connected to the frame and body to angularly adjust the position of the body relative to the frame.

9. The apparatus of claim 8 wherein: the adjustable means is a double acting hydraulic cylinder operable to pivot the body about the transverse axis of said annular resilient and elastic member.

10. The apparatus for making a continuous slit trench in the ground to facilitate the laying of linear structures, as lines, pipes, cables, and the like in the ground comprising: a frame having a forward portion adapted to be connected to a pulling vehicle, said frame having a pair of plate members located in laterally spaced side-by-side vertical planes, a body located adjacent said frame, said body being located between said plate members, means connecting the body to the frame, said means including an annular resilient and elastic member, and a cylindrical hub carrying the annular resilient and elastic member, said body having a hole accommodating the annular resilient and elastic member, means attaching the cylindrical hub to the plate members; a member located adjacent the body, link means pivotally connecting lower portions of the body and the member, a ground penetrating plow secured to the member adapted to make a slit trench on forward movement of the apparatus, and means connected to the member operable to move the plow in an orbital path along the length of the plow, said annular resilient and elastic member being an energy receiving and transmitting member operable to alter the orbital movement of the plow in relation to the load applied to the plow.

11. The apparatus of claim 10 including: annular rings mounted on the body and engageable with the annular resilient and elastic member to hold the annular resilient and elastic member under compression.

12. The apparatus of claim 10 including: a wheel assembly mounted on the frame and engageable with the ground to control the depth of the plow in the ground.

13. The apparatus of claim 10 including: a wheel assembly for controlling the depth of the plow in the ground, said wheel assembly having a pair of legs pivotally connected to the frame, ground engaging wheels rotatably mounted on the legs, and power means for rotating the legs to selectively raise or lower the standard relative to the ground.

14. The apparatus of claim 10 including: means mounted on the body and engageable with the annular resilient and elastic member to hold the annular, resilient and elastic member under compression.

15. The apparatus of claim 10 wherein: the plow has a forwardly directed lower nose located in general vertical alignment with the transverse axis of the annular resilient and elastic member.

16. The apparatus of claim 10 wherein: the means connected to the member operable to move the plow in an orbital path includes a crank shaft having an off-set portion connected to the member, and means to rotate the crank shaft.

17. The apparatus of claim 10 including: adjustable means connected to the frame and body to angularly adjust the position of the body relative to the frame.

18. The apparatus of claim 17 wherein: the adjustable means is a double acting hydraulic cylinder operable to pivot the body about the transverse axis of said annular resilient and elastic member.

19. Apparatus for making a continuous slit trench in the ground to facilitate the laying of linear structures, as lines, pipes, cables and the like, in the ground comprising: a frame having a forward portion adapted to be connected to a pulling vehicle, a body located adjacent said frame, means connecting the body to the frame, said means including an annular resilient and elastic member; a member located adjacent the body, link means pivotally connecting lower portions of the body and member; a ground penetrating plow secured to the member adapted to make a slit trench on forward movement of the apparatus; means connected to the member operable to move the plow in an orbital path along the length of the plow, said annular resilient and elastic member being an energy receiving and transmitting member operable to alter the orbital movement of the plow in relation to the load applied to the plow, an annular rim secured to the inside of the annular resilient and elastic member, said means connecting the body to the frame including a cylindrical hub and means connecting the hub to the frame, said rim being positioned about said hub, and adjustable means connected to the frame and body to hold the body in a selected position relative to the frame.

20. The apparatus of claim 19 wherein: the adjustable means is a double acting hydraulic cylinder operable to pivot the body about the transverse axis of said annular resilient and elastic member.

21. The apparatus of claim 19 including: a wheel assembly mounted on the frame and engageable with the ground to control the depth of the plow in the ground.

22. The apparatus of claim 19 wherein: the frame has a pair of flat plate members located in spaced side-by-side vertical planes, said forward portion having a pair of cross members extend between and secured to the plate members, said cross members having aligned vertical holes to accommodate a pin for connecting the frame to a pulling vehicle.

23. The apparatus of claim 19 including: annular rings mounted on the body and engageable with the annular resilient and elastic member to hold the annular resilient and elastic member under compression.

24. The apparatus of claim 19 including: means mounted on the body and engageable with the annular resilient and elastic member to hold the annular resilient and elastic member under compression.

25. The apparatus of claim 19 wherein: the plow has a forwardly directed lower nose located in general vertical alignment with the transverse axis of the annular resilient and elastic member.

26. The apparatus of claim 19 wherein: the means connected to the member operable to move the plow in an orbital path includes a crank shaft having an off-set portion connected to the member, and means to rotate the crank shaft.

27. The apparatus of claim 19 including: a wheel assembly for controlling the depth of the plow in the ground, said wheel assembly having a pair of legs pivotally connected to the frame, ground engaging wheels rotatably mounted on the legs, and power means for rotating the legs to selectively raise or lower the standard relative to the ground.

28. Apparatus for making a slit trench in the ground comprising: a frame adapted to be connected to a draft vehicle, a body having a cylindrical wall forming an opening through the body, a cylindrical hub extended through the opening, means mounting the hub on the frame, an annular rim surrounding the hub and rotatable relative to the hub, an annular elastic member surrounding the rim and engageable with the cylindrical wall of the body, a downwardly directed ground penetrating plow adapted to make a slit trench in the ground on forward movement of the apparatus, rotatable means mounted on the body, said rotatable means having an eccentric portion, connecting means mounted on the eccentric portion and secured to the plow, link means pivotally connected to the connecting means and body providing the plow with orbital movement in response to rotation of the rotatable means, said annular elastic member being an energy receiving and transmitting member operable to alter the orbital movement of the plow in relation to the load applied to the plow, means to rotate the rotatable means, and adjustable means connected to the frame and body to angularly adjust the position of the body relative to the frame by rotating the rim relative to the hub.

29. The apparatus of claim 28 wherein: the frame includes a pair of side-by-side plate members extended adjacent opposite sides of the body, said hub extended between the plate members, said means mounting the hub on the frame attaching the hub to the plate members.

30. The apparatus of claim 28 including: annular members mounted on the body and engageable with the sides of said annular elastic member to hold the annular elastic member under compression.

31. The apparatus of claim 28 wherein: the plow has a forwardly directed lower nose located in general vertical alignment with the transverse axis of the hub.

32. The apparatus of claim 28 including: a wheel assembly for controlling the depth of the plow in the ground, said wheel assembly having a pair of legs pivotally connected to the frame, ground engaging wheels rotatably mount on the legs, and power means for rotating the legs to selectively raise or lower the standard relative to the ground.

33. The apparatus of claim 28 wherein: said adjustable means is a double acting hydraulic cylinder.

34. Apparatus for making a slit trench in the ground comprising: a frame adapted to be connected to a draft vehicle, a body having a cylindrical wall forming an opening through the body, a cylindrical hub extended through the opening, means mounting the hub on the frame, said frame including a pair of side-by-side plate members extended adjacent opposite sides of the body, said hub extended between the plate members, said means mounting the hub on the frame attaching the hub to the plate members, an annular elastic means surrounding the hub and engageable with the cylindrical wall of the body, a downwardly directed ground penetrating plow adapted to make a slit trench in the ground on forward movement of the apparatus, rotatable means mounted on the body, said rotatable means having an eccentric portion, connecting means mounted on the eccentric portion and secured to the plow, link means pivotally connected to the connecting means and body providing the plow with orbital movement in response to rotation of the rotatable means, said annular elastic means being an energy receiving and transmitting member operable to alter the orbital movement of the plow in relation to the load applied to the plow, and means to rotate the rotatable means.

35. The apparatus of claim 34 including: annular members mounted on the body and engageable with the sides of said annular elastic means to hold the annular elastic means under compression.

36. Apparatus for making a slit trench in the ground comprising: a frame adapted to be connected to a draft vehicle, a body having a cylindrical wall forming an opening through the body, a cylindrical hub extended through the opening, means mounting the hub on the frame, an annular elastic means surrounding the hub and engageable with the cylindrical wall of the body, annular members mounted on the body and engageable with the sides of said annular elastic means to hold the annular elastic means under compression, a downwardly directed ground penetrating plow adapted to make a slit trench in the ground on forward movement of the apparatus, rotatable means mounted on the body, said rotatable means having an eccentric portion, connecting means mounted on the eccentric portion and secured to the plow, link means pivotally connected to the connecting means and body providing the plow with orbital movement in response to rotation of the rotatable means, said annular elastic means being an energy receiving and transmitting member operable to alter the orbital movement of the plow in relation to the load applied to the plow, and means to rotate the rotatable means.

37. The apparatus of claim 36 wherein: the plow has a forwardly directed lower nose located in general vertical alignment with the transverse axis of the hub.

38. The apparatus of claim 36 including: a wheel assembly for controlling the depth of the plow in the ground, said wheel assembly having a pair of legs pivotally connected to the frame, ground engaging wheels rotatably mount on the legs, and power means for rotating the legs to selectively raise or lower the standard relative to the ground.

39. The apparatus of claim 36 including: adjustable means connected to the frame and body to angularly adjust the position of the body relative to the frame.

40. The apparatus of claim 39 wherein: the adjustable means is a double acting hydraulic cylinder operable to pivot the body about the transverse axis of said annular resilient and elastic member.

41. The apparatus of claim 36 including: adjustable means engageable with the annular members for adjusting the compression of the annular elastic means.

* * * * *

UNITED STATES PATENT AND TRADEMARK OFFICE

CERTIFICATE OF CORRECTION

PATENT NO. : 4,102,403

DATED : July 25, 1978

INVENTOR(S) : Richard W. Steinberg

It is certified that error appears in the above-identified patent and that said Letters Patent are hereby corrected as shown below:

Column 3, line 38, delete "7" after "Hydraulic".

Column 4, line 29, "55" should be -- 53 --.

Column 8, line 12, should read -- dard has a maximum orbital movement and power --.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*